United States Patent [19]

Gritzner et al.

[11] 4,032,105

[45] June 28, 1977

[54] MOLD WITH IMPROVED CORE FOR METAL CASTING OPERATION

[75] Inventors: Verne B. Gritzner; Donald W. Hackett, both of Oak Ridge, Tenn.

[73] Assignee: The United States of America as represented by the United States Energy Research and Development Administration, Washington, D.C.

[22] Filed: Apr. 25, 1975

[21] Appl. No.: 571,445

[52] U.S. Cl. ..... 249/134; 249/144; 249/147; 164/138

[51] Int. Cl.[2] ..... B29C 1/06; B29C 9/10; B29C 9/24

[58] Field of Search ..... 249/144, 146, 147, 148, 249/150, 151, 134, 142; 164/138, 369, 370, 33

[56] References Cited

UNITED STATES PATENTS

| | | | |
|---|---|---|---|
| 665,865 | 1/1901 | Baker | 249/148 X |
| 1,864,451 | 6/1932 | Lüngen | 164/369 |
| 3,258,816 | 7/1966 | Rearwin | 164/369 X |
| 3,431,970 | 3/1969 | Olstowski et al. | 164/369 X |
| 3,574,548 | 4/1971 | Sands et al. | 264/29 X |
| 3,863,701 | 2/1975 | Niimi et al. | 164/369 X |

*Primary Examiner*—Ronald J. Shore
*Attorney, Agent, or Firm*—Dean E. Carlson; Stephen D. Hamel; Earl L. Larcher

[57] ABSTRACT

The present invention is directed to a mold containing an improved core for use in casting hollow, metallic articles. The core is formed of, or covered with, a layer of cellular material which possesses sufficient strength to maintain its structural integrity during casting, but will crush to alleviate the internal stresses that build up if the normal contraction during solidification and cooling is restricted.

2 Claims, 1 Drawing Figure

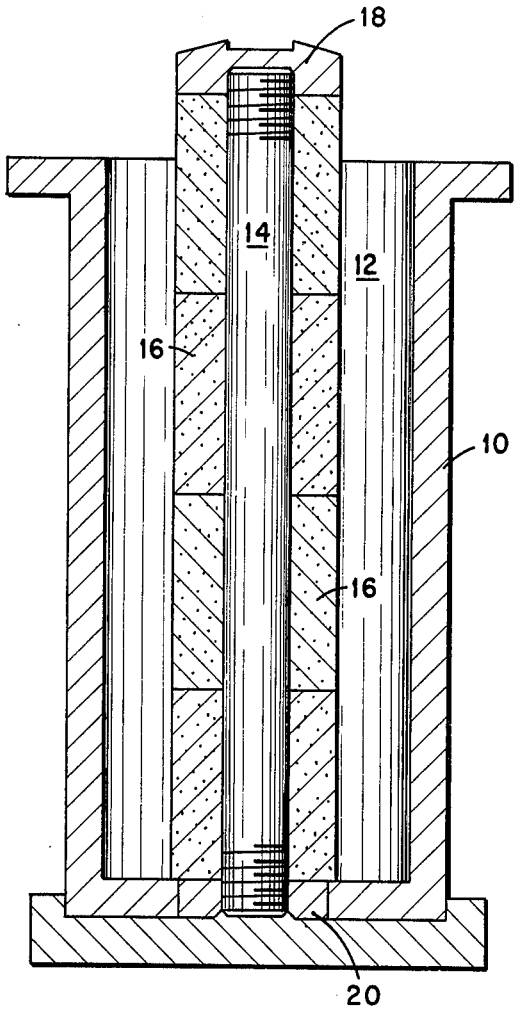
18
14
12
16
10
16
20

MOLD WITH IMPROVED CORE FOR METAL CASTING OPERATION

The present invention is generally directed to a mold employed for casting hollow metallic articles and more particularly to an improved core for use in such a mold wherein the core is at least partially formed of a crushable, cellular material for inhibiting the occurrence of delerious internal stresses in the casting. This invention was made in the course of, or under, a contract with the United States Energy Research and Development Adminstration.

Mold casting techniques have been previously employed for producing metallic articles of hollow configurations. A major problem encountered during such casting operations is that during cooling of the cast metal, the metal contracts against the core and, if the core is of sufficient strength to resist deformation during this contraction, the cast material necessarily yields to induce internal stresses therein which could lead to the formation of cracks or weak areas in the casting. This problem has been minimized by employing a sand core which is a well-known procedure commonly referred to as sand casting. However, the use of such sand casting procedures is quite expensive and involves relatively complex operations so as to considerably detract from mold casting of hollow metallic articles.

Accordingly, it is the primary objective of the present invention to provide a mold with an improved core for use in casting hollow metallic articles. The improved core utilizes cellular material which has sufficient strength and rigidity to withstand the forces exerted by the poured molten material and yet yields or compresses under the forces of contraction generated by the solidification of the cast metal so as to inhibit deleterious stresses from occurring in the casting.

Other and further objects of the invention will be obvious upon an understanding of the illustrative embodiment about to be described, or will be indicated in the appended claims, and various advantages not referred to herein will occur to one skilled in the art upon employment of the invention in practice.

A preferred embodiment of the invention has been chosen for the purpose of illustrative and description. The preferred embodiment illustrated is not intended to be exhaustive or to limit the invention to the precise form disclosed. It is chosen and described in order to best explain the principles of the invention and their application in practical use to thereby enable others skilled in the art to best utilize the invention in various embodiments and modifications as are best adapted to the particular use contemplated.

In the accompanying drawing:

The FIG. is a somewhat schematic illustration showing a mold with the improved core of the present invention as it may be employed in the casting of a cylindrical article.

Described generally, the present invention is directed to a mold in which an improved core is employed in casting hollow metallic articles, such as cylinders, crucibles, cones, and the like. The core is at least partially formed of a cellular material having a compressive strength sufficient for withstanding the pressures of the surrounding metallic casting material in a molten state and yet is incapable of maintaining its structural integrity under forces generated by the contraction of the casting during the solidification upon cooling. The cellular material useable for preparing the core of the present invention may be of any well-known material, such as the cellular material described in assignee's U.S. Pat. No. 3,574,548, issued Apr. 13, 1971, and entitled "Process For Manufacturing A Cellular Carbon Body." Alternatively, the cellular material may be of any commercially available cellular metallic or nonmetallic material which is capable of withstanding the forces generated during the casting of molten metal and yet will yield under the influence of the contracting forces of the metal. However, the selected cellular material must be one which will not excessively deform or contaminate the metallic material during the casting operation. A particularly suitable cellular material for use in the present invention is carbon foam as described in the aforementioned patent which may be prepared in densities in the range of about 0.05 to 0.90 g/cc with a compressive strength in the range of about 10 to 10,000 psi.

As shown in the drawing, the improved invention is employed in a mold utilized for casting a cylindrical body of a metal such as copper or any other castable metallic material as well known in the art. This mold is shown comprising a graphite housing 10 having a tubular metal receiving receptacle 12 therein. Within this housing there is disposed the improved core assembly of the present invention which is shown comprising a solid central boss 14 of graphite which is positioned in the base of the mold housing by a receptacle arrangement, as shown, or in any other suitable manner. Surrounding the boss 14 is a number (four shown) of cylindrical 16 of carbon foam which provide the crushable core of the present invention. The boss 14, in turn, is provided with threaded caps 18 and 20 for holding the carbon foam cylinders 16 in place. However, while the cellular material is shown supported by a central boss, it may be desired to form the entire core from cellular material and anchor it in the selected position within the mold housing in any suitable manner, such as bolting, pinning with chaplets, or by any other other well-known fastening techniqes. The thickness of the carbon foam cylinders, or sleeves, disposed about the boss may be any desired thickness but with the minimum amount being that which will provide the necessary deformation during the contraction of the metallic material so as to prevent the occurrence of cracking or deleterious internal stresses within the casting.

In order to provide a more facile understanding of the present invention, a typical application of the subject invention is set forth below for the forming of a copper cylinder having an inside diameter of about 8.5 inches, an outside diameter of 10 inches, and a length of 40 inches. For providing this casting a core assembly was prepared with four carbon foam cylinders, such as shown in the drawing, with each cylinder having a wall thickness of about 2 inches. The carbon foam utilized for this operation had a density of 0.05 g/cc and a compressive strength of 50 psi. The carbon foam cylinders were anchored in place on a solid graphite boss with threaded ends. This boss, in turn, had a diameter of approximately 4 inches and a length of 48 inches. A cap nut of solid graphite was attached at each end of the rod to complete the core assembly which was then positioned in the center of the graphite mold for the casting operation. The casting operation was performed in an induction furnace with a charge of copper, approximately 210 kilograms, being heated to 1200° C in a vacuum and then bottom poured into the mold. After solidification and cooling, the core structure was removed from the mold housing and then the cooper cylinder was easily pulled from the mold. Visual and radiographic examinations of the cylinder indicated a sound structure without cracks.

It will be seen that the present invention provides a relatively simple structure for use in mold casting metallic articles of hollow configuration, with this structure providing a simple and effective solution to the otherwise expensive casting techniques, such as sand casting previously used for forming hollow articles. The cellular structures used in forming the core of the present invention are not as fragile as the sand cores previously employed which significantly enhances the handling and transportation characteristics of the core material. Further, the techniques and apparatus for positioning the cores in the mold are less complicated and expensive than the sand cores. Also, the heat from the casting operation does not damage the core of carbonized cellular foam whereas the binders in the sand core are deleteriously affected by the thermal conditions in the melt.

We claim:

1. A mold for use in the process of casting molten metallic material into a hollow article of a desired configuration comprising a housing having a metal receiving receptacle therein and a core disposed within said receptacle for defining therewith an annulus in the desired configuration, said core being separable from the cast article and being characterized by having at least a portion thereof formed of carbon foam with said portion being contactable by the molten metallic material forming the article and possessing both sufficient strength to resist deformation during the introduction of the molten metallic material into said annulus and adequate yieldability to undergo deformation during the solidification and attendant contraction of the molten metallic material for inhibiting deleterious internal stresses leading to cracking or weak areas from occurring in the article during said contraction.

2. A mold for use in the process of casting molten metallic material into a hollow article of a desired configuration comprising a housing having a metal receiving receptacle therein and a core disposed within said receptacle for defining therewith an annulus in the desired configuration, said core being separable from the cast article and being characterized by a graphite boss, a cellular material disposed about said boss and contactable by the molten metallic material forming the article with said cellular material possessing both sufficient strength to resist deformation during the introduction of a molten metallic material into said annulus and adequate yieldability to undergo deformation during the solidification and attendant contraction of the molten metallic material for inhibiting deleterious stresses from occurring in the article during said contraction.

* * * * *